US009416596B2

(12) United States Patent
Maier

(10) Patent No.: US 9,416,596 B2
(45) Date of Patent: Aug. 16, 2016

(54) INSTALLATION OF LINES IN HIGH TEMPERATURE WELLBORE ENVIRONMENTS

(75) Inventor: Gary Maier, Calgary (CA)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 700 days.

(21) Appl. No.: 13/152,155

(22) Filed: Jun. 2, 2011

(65) Prior Publication Data

US 2011/0303419 A1 Dec. 15, 2011

(51) Int. Cl.
*E21B 33/126* (2006.01)
*E21B 17/02* (2006.01)

(52) U.S. Cl.
CPC ..... *E21B 17/026* (2013.01); *E21B 33/126* (2013.01)

(58) Field of Classification Search
CPC ..... E21B 33/1208; E21B 33/126; E21B 17/1035; E21B 33/12; E21B 33/128; E21B 33/136; E21B 33/005
USPC ..... 166/202, 188; 277/335, 439, 626
See application file for complete search history.

(56) References Cited

U.S. PATENT DOCUMENTS

| | | | | |
|---|---|---|---|---|
| 56,234 | A * | 7/1866 | Latham | 166/189 |
| 2,274,740 | A * | 3/1942 | Reynolds | 166/114 |
| 2,495,953 | A * | 1/1950 | Austin | 166/54.5 |
| 3,012,608 | A * | 12/1961 | McLaren, Jr. | 175/4.51 |
| 3,468,258 | A * | 9/1969 | Arutunoff | 166/212 |
| 7,959,155 | B2 * | 6/2011 | Templeton et al. | 277/335 |
| 2004/0065437 | A1 | 4/2004 | Bostick et al. | |
| 2005/0263282 | A1 * | 12/2005 | Jeffrey et al. | 166/281 |
| 2008/0099209 | A1 * | 5/2008 | Loretz et al. | 166/376 |
| 2009/0014168 | A1 | 1/2009 | Tips et al. | |
| 2009/0173505 | A1 * | 7/2009 | Patel et al. | 166/385 |
| 2009/0277652 | A1 | 11/2009 | Nutley et al. | |
| 2010/0155077 | A1 * | 6/2010 | Jardim De Azevedo et al. | 166/369 |
| 2011/0061862 | A1 * | 3/2011 | Loretz et al. | 166/250.11 |

OTHER PUBLICATIONS

International Search Report with Written Opinion issued Mar. 15, 2011 for PCT International Application No. PCT/US2010/038651, 9 pages.
Office Action issued Jan. 15, 2014 for Canadian Patent Application No. 2,802,403, 2 pages.
Canadian Office Action PCTUS2010038651, dated Aug. 6, 2015.

* cited by examiner

*Primary Examiner* — Black Michener
*Assistant Examiner* — Kipp Wallace
(74) *Attorney, Agent, or Firm* — Locke Lord LLP

(57) ABSTRACT

An annular restrictor for use in a well can include a body which extends circumferentially about a tubular mandrel, and a section which, in cooperation with the body, restricts fluid flow through an annulus, a line being secured between the body and the section. A method of completing a well can include installing a line in an annular restrictor, and restricting fluid flow through an annulus, with the restricting being performed by the annular restrictor interconnected between steam injection valves. A method of attaching a line to a tubular string for use in a well can include covering the line with a section of an annular restrictor, and securing the section to a body of the annular restrictor, each of the section and the body having a flow restricting surface formed thereon, and the covering and securing steps being performed without splicing or making a connection in the line.

14 Claims, 4 Drawing Sheets

INSTALLATION OF LINES IN HIGH TEMPERATURE WELLBORE ENVIRONMENTS

CROSS-REFERENCE TO RELATED APPLICATION

This application claims the benefit under 35 USC §119 of the filing date of International Application Serial No. PCT/US10/38651 filed 15 Jun. 2010. The entire disclosure of this prior application is incorporated herein by this reference.

BACKGROUND

The present disclosure relates generally to equipment and operations utilized in conjunction with a subterranean well and, in an embodiment described herein, more particularly provides for installation of lines in high temperature wellbore environments.

It is known to extend various types of lines (such as hydraulic, electrical and/or fiber optic lines) through packers in subterranean wells. However, the lines are typically rigidly attached to the packers and/or other components of a tubular string.

The packer attachments typically require splicing the lines, or at least making connections in the lines. In high temperature environments (such as steam injection completions, very deep wellbores, etc.), the tubular string will expand, and so a travel joint is generally used to absorb this expansion.

It will be appreciated that improvements are needed in the art of securing lines to tubular strings in high temperature wellbore environments. These improvements could include elimination of the need for a travel joint, elimination of the need for making splices and connections in the lines, and/or elimination of the need for a packer to restrict fluid flow through an annulus.

SUMMARY

In carrying out the principles of the present disclosure, apparatus, systems and methods are provided which bring improvements to the art of installation of lines in high temperature wellbore environments. One example is described below in which lines are secured in an annular restrictor without splicing or making connections in the lines. Another example is described below in which the annular restrictor is used between steam injection valves in a well completion.

In one aspect, an annular restrictor for use in a subterranean well is provided to the art by the present disclosure. The annular restrictor can include a body which extends circumferentially about a tubular mandrel, and a section which, in cooperation with the body, restricts fluid flow through an annulus in the well. At least one line is secured between the body and the section.

In another aspect, a method of completing a subterranean well is provided. The method can include installing at least one line in an annular restrictor, and restricting fluid flow through an annulus formed radially between a tubular string and a wellbore. The restricting is performed by the annular restrictor interconnected between steam injection valves.

In yet another aspect, a method of attaching at least one line to a tubular string for use in a subterranean well can include: covering the line with a section of an annular restrictor, and securing the section to a body of the annular restrictor. Each of the section and the body has a flow restricting surface formed thereon. The covering and securing steps are performed without splicing or making a connection in the line.

These and other features, advantages and benefits will become apparent to one of ordinary skill in the art upon careful consideration of the detailed description of representative embodiments of the disclosure hereinbelow and the accompanying drawings, in which similar elements are indicated in the various figures using the same reference numbers.

DETAILED DESCRIPTION

Figure 1:
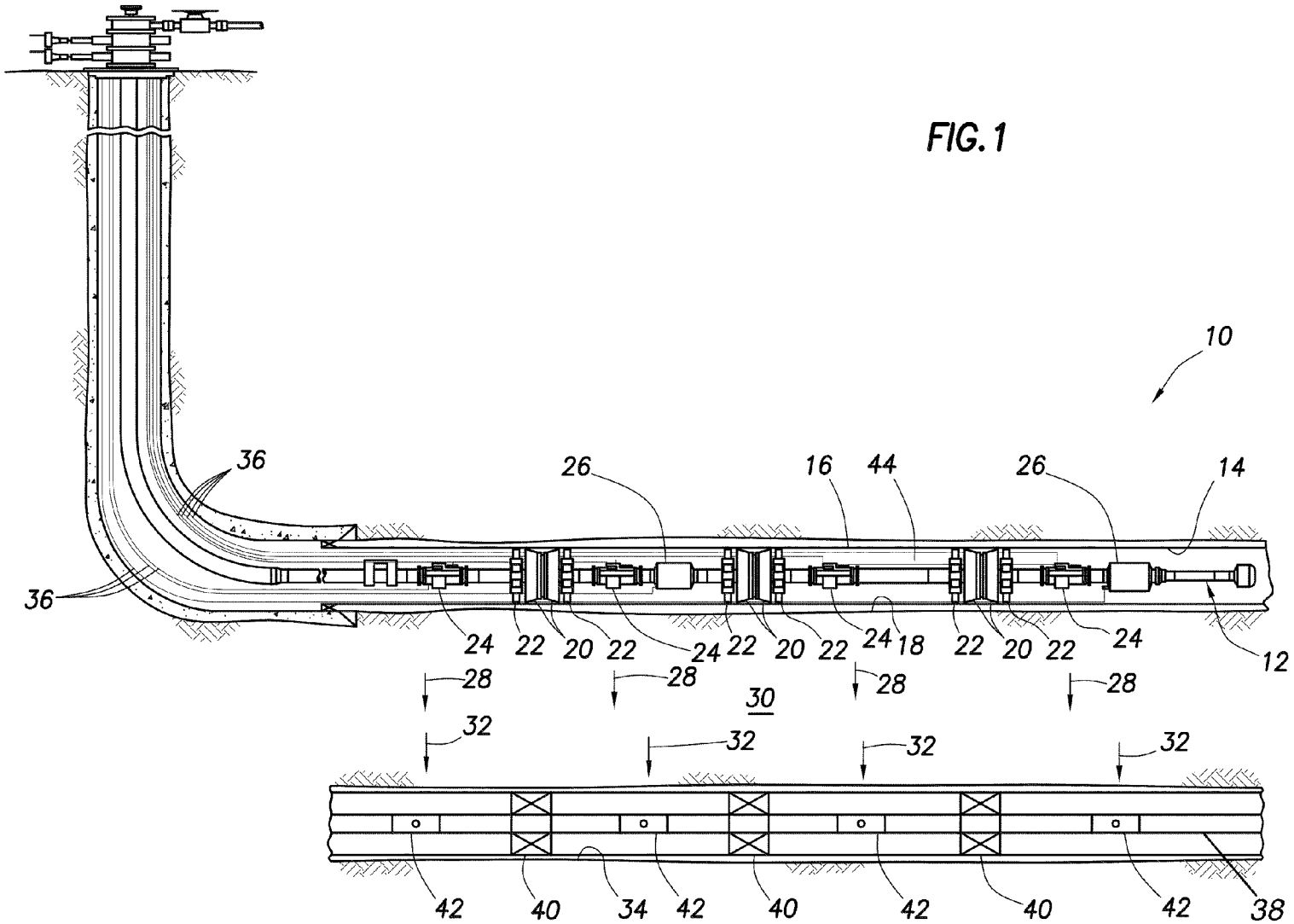
FIG. 1 is a schematic partially cross-sectional view of a well system and method which can embody principles of the present disclosure.

Representatively illustrated in FIG. 1 is a well system 10 and associated method which can embody principles of the present disclosure. In the system 10, a tubular string 12 in installed in a well bore 14.

In this example, the bore 14 is formed in a slotted liner 16 installed in an otherwise open wellbore 18. However, in other examples, the slotted liner 16 may not be used or may be replaced by casing, etc. Thus, the bore 14 could be formed in a tubular structure (such as in casing liner, tubing, etc.), or the bore could be formed by the wall of the wellbore 18, in other embodiments.

As depicted in FIG. 1, annular restrictors 20, centralizers 22, steam injection valves 24 and instrument carriers 26 are interconnected in the tubular string 12. Steam 28 is injected via the valves 24 into a formation 30, in order to mobilize hydrocarbon fluids 32 in the formation, and allow the fluids to drain into another wellbore 34 drilled into the formation.

Thus, the well system 10 is of the type known to those skilled in the art as steam assisted gravity drainage (SAGD). However, it should be clearly understood that the principles of this disclosure are not limited to use only in steam assisted gravity drainage well systems.

Various lines 36 are connected to the steam injection valves 24 and instrument carriers 26. The lines 36 can include hydraulic, electrical and/or optical lines for actuating the valves 24, transmitting sensor data from the instrument carriers 26, transmitting command and control signals, etc.

The lines 36 can also be used for sensing purposes (for example, in optical distributed temperature, acoustic and/or strain sensing, etc.). The lines 36 may be used for any purposes in keeping with the principles of this disclosure.

In the lower wellbore 34, a tubular string 38 is installed, with packers 40 and production valves 42 interconnected therein. Note that, the annular restrictors 20 could be used in place of the packers 40, if desired, and so it will be appreciated that the principles of this disclosure are not limited to use in an injection operation, but can also be used in production operations, and/or in any other types of well operations. The steam injection valves 24 could also, or alternatively, be used for the production valves 42.

The annular restrictors 20 restrict fluid flow through an annulus 44 formed radially between the tubular string 12 and the well bore 14. The annular restrictors 20 do not necessarily seal off the annulus 44, but in other examples the annular restrictors could completely seal off the annulus to thereby prevent fluid flow through the annulus. As used herein, the term "restricts," "restricting," and similar terms encompass both non-sealing and sealing.

The centralizers 22 help to prevent damage to the annular restrictors 20 during installation of the tubular string 12 in the well bore 14. The lines 36 extend longitudinally through the annular restrictors 20 and centralizers 22 in a manner which permits some longitudinal displacement of the lines relative to the tubular string 12, and which eliminates the need for making splices and/or connections in the lines, as described more fully below.

Figure 2A:
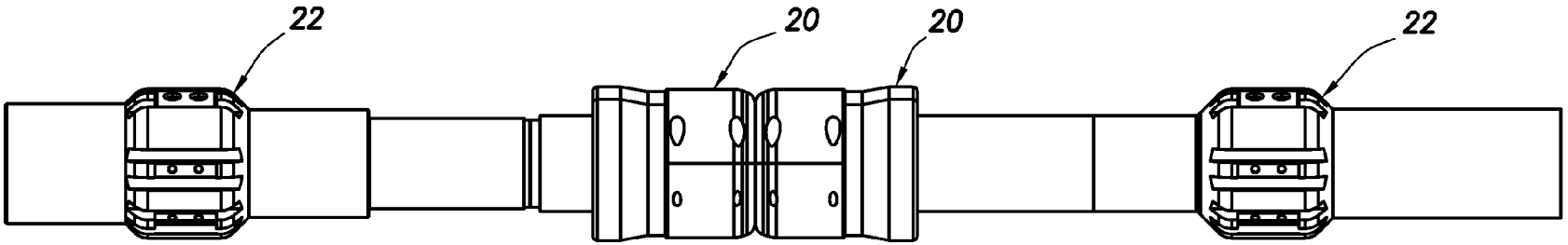
FIG. 2A is a schematic elevational view of annular restrictors and centralizers which may be used in the system and method of FIG. 1.

Referring additionally now to FIGS. 2A & B, enlarged scale views of the annular restrictors 20 and centralizers 22 are representatively illustrated. In these more detailed views, it may be seen that the centralizers 22 are preferably interconnected in the tubular string 12 so that they straddle the annular restrictors 20.

In this example, the centralizers 22 have somewhat larger outer diameters than the annular restrictors 20, in order to protect the annular restrictors from damage during installation. However, in other examples the centralizers 22 may not have larger outer diameters than the annular restrictors 20.

As depicted in FIGS. 2A & B, two of the annular restrictors 20 are interconnected between two of the centralizers 22. The annular restrictors 20 are somewhat similar to "cup" packers, in that they are cup-shaped and, in this example, the open cup end of each annular restrictor faces outwardly (e.g., longitudinally away from the other annular restrictor), so that the annular restrictors effectively restrict fluid flow from either longitudinal direction.

Each annular restrictor 20 includes a body 46, a section 48 which removes from the body for installation of the lines 36 (not shown in FIGS. 2A & B), and a clamp 50. The body 46, section 48 and clamp 50 are carried on a tubular mandrel 52.

One advantage of using the annular restrictors 20 is that they allow for elongation and contraction of the tubular string 12 with thermal changes (i.e., the tubular string can displace relative to the well bore 14), without the need for travel joints. Unlike a packer which grips a wellbore wall, the annular restrictors 20 do not rigidly secure the tubular string 12 to the well bore 14.

Figure 3:
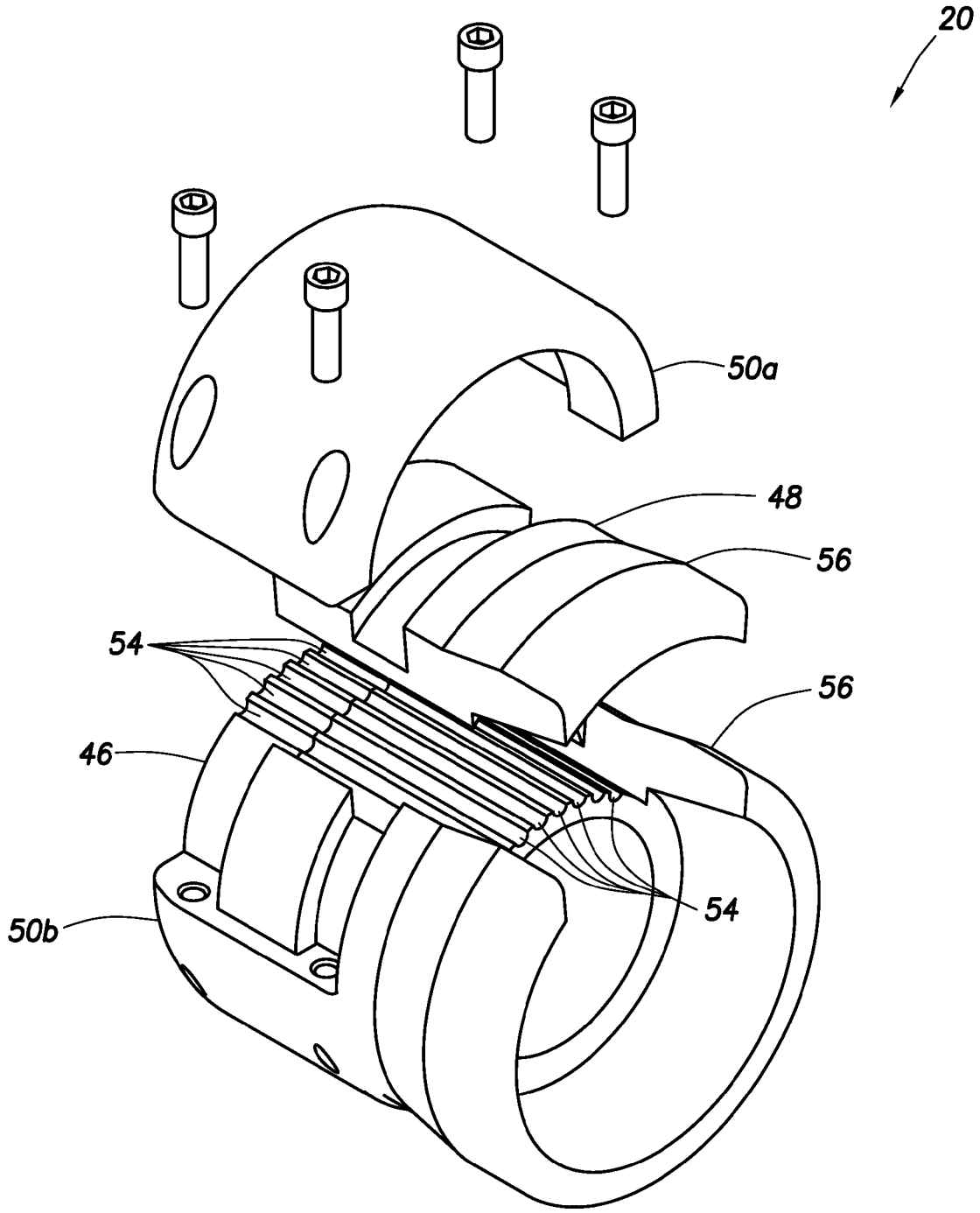
FIG. 3 is a schematic orthogonal exploded view of one of the annular restrictors.

Referring additionally now to FIG. 3, an enlarged scale exploded view of an annular restrictor 20 is representatively illustrated, apart from the remainder of the well system 10. In this view, it may be clearly seen that the section 48 can be removed from the body 46 to expose line-receiving recesses 54 formed in the body.

With the lines 36 received in the recesses 54, the section 48 can be secured to the body 46 using the clamp 50*a,b* to thereby secure the lines to the tubular string 12, without the need for making splices or other connections in the lines. In some embodiments, the lines 36 could also displace longitudinally through the recesses 54 if needed when the tubular string 12 expands or contracts.

Figure 2B:
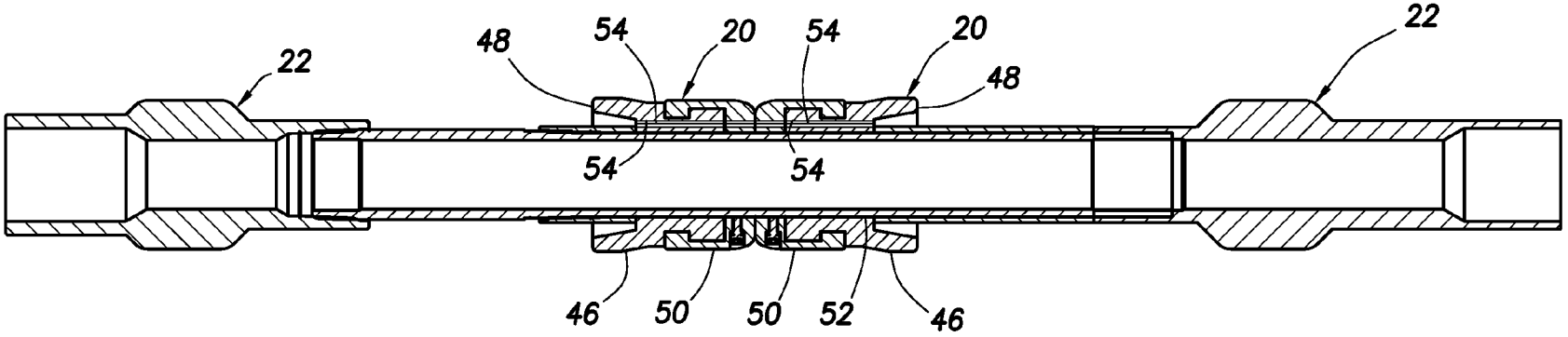
FIG. 2B is a schematic vertical cross-sectional view of the annular restrictors and centralizers of FIG. 2A.

Note that, although not visible in FIG. 3, the recesses 54 can also be formed on an inner surface of the section 48 (see FIG. 2B).

When the section 48 is appropriately secured to the body 46, a continuous (or at least substantially continuous) circumferential flow restricting surface 56 is formed on each of the body and the section. The surface 56 may be spaced apart from the well bore 14 by the centralizers 22 or, in other examples, the surface could sealingly engage the well bore to thereby completely prevent fluid flow through the annulus 44.

In a preferred embodiment, the body 46 and section 48 are constructed of 40% glass fiber filled PTFE (polytetrafluoroethylene) for high temperature durability. However, other materials may be used, if desired.

Note that the annular restrictor 20 could be used in well systems in which the lines 36 are not also used, or in which the lines do not extend through the annular restrictor. In those situations, the separate section 48 would not necessarily be used, but instead the section could be integrally formed with the body 46, and the recesses 54 would either not be used, or would be plugged.

Figure 4:
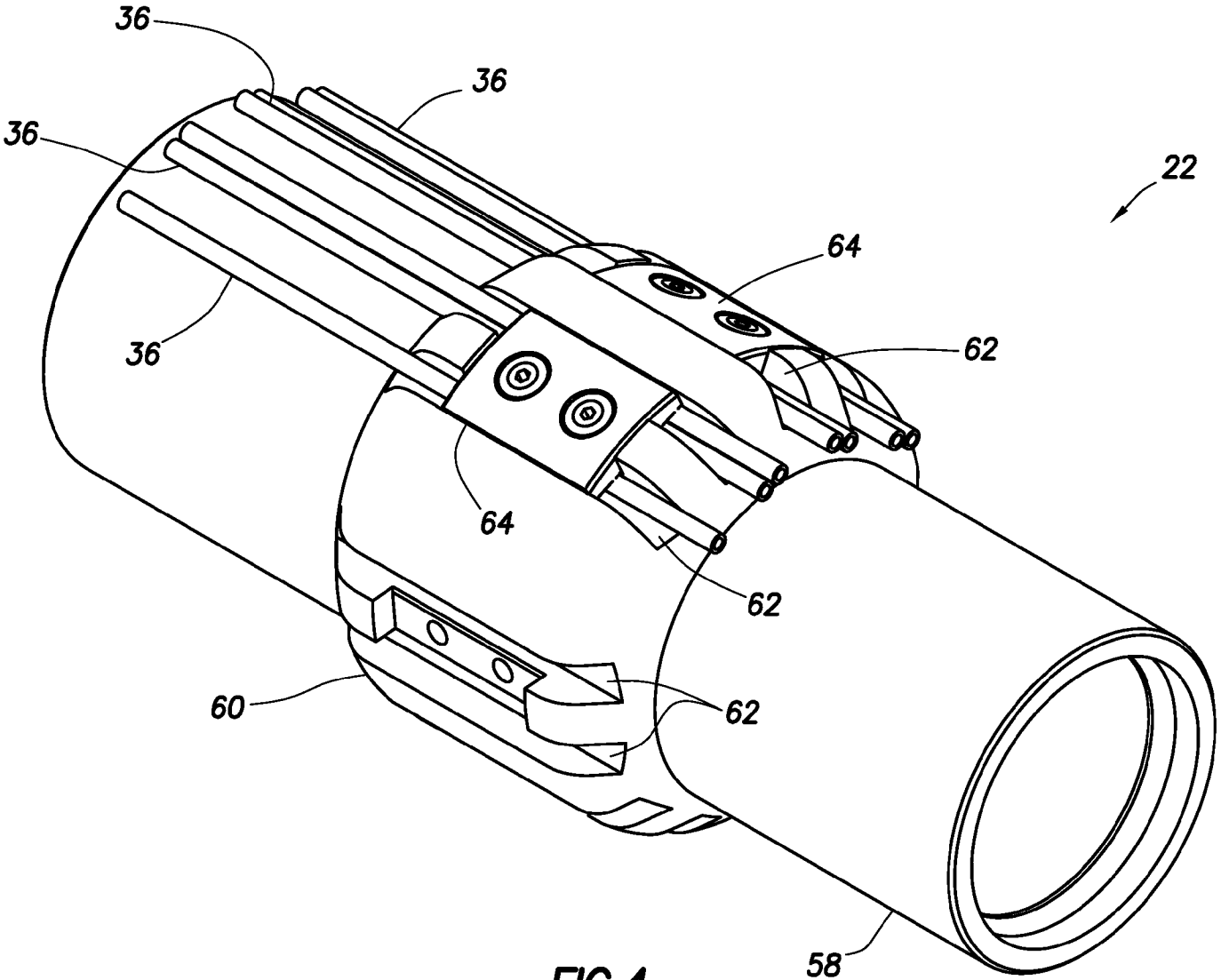
FIG. 4 is a schematic orthogonal view of one of the centralizers.

Referring additionally now to FIG. 4, an enlarged scale view of a centralizer 22 is representatively illustrated. In this view, it may be clearly seen that the centralizer 22 includes a generally tubular housing 58 with a radially enlarged centralizing structure 60 having a series of longitudinally extending line-receiving slots 62 formed therein.

Clamps 64 are used to secure the lines 36 in the slots 62. Preferably, the clamps 64 are recessed somewhat relative to the outer surface of the centralizing structure 60, so that they are not subject to impacts and wear during installation.

It may now be fully appreciated that several advancements are provided to the art by the above disclosure. In particular, the lines 36 can be secured to the tubular string 12 as the tubular string is installed in the well, without the need for making splices and/or other connections in the lines. The annular restrictors 20 substantially restrict fluid flow through the annulus 44 (thereby allowing for control over the amount of steam 28 injected into each zone or section of the formation 30), and secure the lines 36 to the tubular string 12, while also allowing for relative displacement between the tubular string and the well bore 14.

The above disclosure provides to the art an annular restrictor 20 for use in a subterranean well. The annular restrictor 20 can include a body 46 which extends circumferentially about a tubular mandrel 52, and a section 48 which, in cooperation with the body 46, restricts fluid flow through an annulus 44 in the well. At least one line 36 is secured between the body 46 and the section 48.

At least one line-receiving recess 54 may be formed on the body 46 and/or the section 48. The line-receiving recess 54 can be formed on both of the body 46 and the section 48.

The annular restrictor 20 can also include a clamp 50 which secures the section 48 to the body 46.

The body 46 and section 48 can form a cup shape.

Each of the body 46 and the section 48 can include a flow restricting surface 56.

Also described by the above disclosure is a method of completing a subterranean well. The method can include: installing at least one line 36 in an annular restrictor 20; and restricting fluid flow through an annulus 44 formed radially between a tubular string 12 and a well bore 14, with the restricting being performed by the annular restrictor 20 interconnected between steam injection valves 24.

The line 36 may be operatively connected to at least one of the steam injection valves 24.

The installing step can be performed without splicing the line 36. The installing step can be performed without making a connection in the line 36.

The installing step can be performed by securing the line 36 between a body 46 of the annular restrictor 20 and a section 48 of the annular restrictor 20. The section 48 may cooperate with the body 46 in restricting fluid flow through the annulus 44.

The above disclosure also describes a method of attaching at least one line 36 to a tubular string 12 for use in a subterranean well, with the method comprising: covering the line 36 with a section 48 of an annular restrictor 20; and securing the section 48 to a body 46 of the annular restrictor 20. Each of the section 48 and the body 46 has a flow restricting surface 56 formed thereon. The covering and securing steps are performed without splicing or making a connection in the line 36.

The annular restrictor 20 may be interconnected between steam injection valves 24.

The tubular string 12 may be free to displace longitudinally relative to the well bore 14 while the annular restrictor 20 restricts fluid flow through an annulus 44 formed radially between the tubular string 12 and the well bore 14.

It is to be understood that the various embodiments of the present disclosure described herein may be utilized in various orientations, such as inclined, inverted, horizontal, vertical, etc., and in various configurations, without departing from the principles of the present disclosure. The embodiments are described merely as examples of useful applications of the principles of the disclosure, which is not limited to any specific details of these embodiments.

In the above description of the representative embodiments of the disclosure, directional terms, such as "above," "below," "upper," "lower," etc., are used only for convenience in referring to the accompanying drawings.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of the present disclosure. Accordingly, the foregoing detailed description is to be clearly understood as being given by way of illustration and example only, the spirit and scope of the present invention being limited solely by the appended claims and their equivalents.

What is claimed is:

1. An annular restrictor for use in a subterranean well, the annular restrictor comprising:

a body which extends circumferentially about a tubular mandrel, the body comprising a slot extending longitudinally along an outer surface of the body; and a section which fits into the slot, wherein the body and the section together form a cup-shaped end of the annular restrictor, and wherein at least one line is secured between the body and the section such that the at least one line can be longitudinally displaced with respect to the body and the section of the restrictor as situated in the subterranean well.

2. The annular restrictor of claim 1, wherein at least one line-receiving recess is formed on at least one of the body and the section.

3. The annular restrictor of claim 2, wherein the line-receiving recess is formed on both of the body and the section.

4. The annular restrictor of claim 1, further comprising a clamp which secures the section to the body.

5. The annular restrictor of claim 1, wherein each of the body and the section includes a flow restricting surface.

6. A method of completing a subterranean well, the method comprising:

laterally installing at least one line in an annular restrictor;

then covering the line with a section of a cup end of the annular restrictor;

then securing the section to the annular restrictor to allow for longitudinal displacement of the same; and restricting fluid flow through an annulus formed radially between a tubular string and a well bore via the annular restrictor, wherein the section is secured to a body of the annular restrictor via a clamp, and wherein the section cooperates with the body in restricting fluid flow through the annulus.

7. The method of claim 6, wherein at least one of the body and the section has a line-receiving recess formed thereon.

8. The method of claim 6, wherein each of the body and the section includes a flow restricting surface.

9. A method of attaching at least one line to a tubular string for use in a subterranean well, the method comprising:

laterally installing the line in an annular restrictor;

then covering the line with a section of the annular restrictor; and then securing the section to a body of the annular restrictor, wherein the section and the body together form a circumferential cup-shaped flow restricting surface, and wherein the covering and the securing are performed without splicing or making a connection in the line, wherein the securing further comprises clamping the section to the body.

10. An annular restrictor for use in a subterranean well, the annular restrictor comprising:

a body which extends circumferentially about a tubular mandrel, the body comprising a slot extending longitudinally along an outer surface of the body; and a section which fits into the slot and which, in cooperation with the body, forms a cup-shaped restriction to fluid flow through an annulus in the well, at least one line being secured between the body and the section, wherein at least one line-receiving recess is formed on both of the body and the section and permits longitudinal displacement of the at least one line with respect to the body and the section of the restrictor as situated in the subterranean well.

11. The annular restrictor of claim 10, wherein the body and section form a cup shape circumscribing the at least one line-receiving recess.

12. The annular restrictor of claim 10, further comprising a clamp which secures the section to the body.

13. The annular restrictor of claim 10, wherein each of the body and the section includes a flow restricting surface.

14. A method of attaching at least one line to a tubular string for use in a subterranean well, the method comprising:

laterally installing the line in an annular restrictor;

covering the line with a section of the annular restrictor to permit longitudinal displacement of the line; and securing the section to a body of the annular restrictor, each of the section and the body forming a corresponding portion of a circumferential cup-shaped flow restricting surface, wherein the covering and the securing are performed without splicing or making a connection in the line, and wherein the annular restrictor is interconnected between steam injection valves, wherein the securing further comprises clamping the section to the body.

* * * * *